US009464472B2

(12) United States Patent
Ng

(10) Patent No.: US 9,464,472 B2
(45) Date of Patent: Oct. 11, 2016

(54) BLIND HINGE USED FOR FURNITURE

(71) Applicant: GUANGDONG TAIMING METAL PRODUCTS CO. LTD, Foshan (CN)

(72) Inventor: Tai Wai Ng, Foshan (CN)

(73) Assignee: Guangdong Taiming Metal Products Co., Ltd., Foshan (CN)

( * ) Notice: Subject to any disclaimer, the term of this patent is extended or adjusted under 35 U.S.C. 154(b) by 0 days.

(21) Appl. No.: 14/600,835

(22) Filed: Jan. 20, 2015

(65) Prior Publication Data

US 2016/0208533 A1 Jul. 21, 2016

(30) Foreign Application Priority Data

Jan. 16, 2015 (CN) ..... 2015 2 0032632 U

(51) Int. Cl.

*E05D 7/04* (2006.01)
*E05F 1/12* (2006.01)
*E05D 3/02* (2006.01)

(52) U.S. Cl.

CPC ..... *E05D 7/0415* (2013.01); *E05D 3/02* (2013.01); *E05F 1/1207* (2013.01); *E05D 2007/0476* (2013.01); *E05D 2007/0492* (2013.01); *Y10T 16/5321* (2015.01)

(58) Field of Classification Search

CPC ..... Y10T 16/532; Y10T 16/5321; Y10T 16/5322; Y10T 16/53225; Y10T 16/5324; Y10T 16/53247; Y10T 16/53253; Y10T 16/53257; Y10T 16/5389; Y10T 16/5383; E05D 5/065; E05D 7/04; E05D 7/0009; E05D 7/0415; E05D 7/0407; E05D 2007/0476; E05D 2007/0492; E05D 3/02; E05Y 2900/20; E05F 1/1207

USPC ..... 16/235–238, 242, 243, 245, 246, 286, 16/308; 312/326

See application file for complete search history.

(56) References Cited

U.S. PATENT DOCUMENTS 6,643,895 B1 * 11/2003 Domenig ..... E05D 7/0415 16/238
6,647,591 B1 * 11/2003 Domenig ..... E05D 7/0415 16/238
7,117,561 B1 * 10/2006 Domenig ..... E05D 7/0407 16/236
7,213,300 B1 * 5/2007 Domenig ..... E05D 7/04 16/236
7,231,691 B1 * 6/2007 Domenig ..... E05D 7/0407 16/236
8,276,241 B2 * 10/2012 Wu ..... E05D 7/0415 16/235
8,347,459 B2 * 1/2013 Heisig ..... E05D 5/08 16/236

(Continued)

FOREIGN PATENT DOCUMENTS

CN 2780937 Y 5/2006
CN 101538971 A * 9/2009

(Continued)

*Primary Examiner* — William Miller
(74) *Attorney, Agent, or Firm* — Maier & Maier, PLLC

(57) ABSTRACT

A blind hinge used for furniture, comprising a movable cup holder provided on the furniture door body, an adjusting base provided on the furniture body, a rotary arm connected between the movable cup holder and the adjusting base as well as an elastic element designed to generate opening/closing acting force on the movable cup holder. The adjusting base is designed as L-shape or bent shape to realize three-dimensional or two-dimensional adjustment to the hinge; a convex step used to support the elastic member is formed on the bottom base of the movable cup holder; the elastic member is a torsion spring, with its section on at least one of its end parts being square or circular; the connecting piece is provided with a boss and a convex part.

6 Claims, 5 Drawing Sheets

(56) References Cited

U.S. PATENT DOCUMENTS

| | | | | |
|---|---|---|---|---|
| 8,683,652 | B2 * | 4/2014 | Hagspiel | E05D 7/0407 16/236 |
| 2004/0163212 | A1 * | 8/2004 | Isele | E05D 7/0415 16/235 |
| 2006/0143859 | A1 * | 7/2006 | Wu | E05D 7/0415 16/242 |
| 2007/0136988 | A1 * | 6/2007 | Bullock | E05D 7/0415 16/245 |
| 2008/0271292 | A1 * | 11/2008 | Lowe | E05D 7/0407 16/238 |
| 2014/0359973 | A1 * | 12/2014 | Ng | E05D 7/00 16/225 |
| 2014/0373309 | A1 * | 12/2014 | Ng | E05D 7/0407 16/308 |
| 2015/0240543 | A1 * | 8/2015 | Ng | E05D 7/0407 16/233 |

FOREIGN PATENT DOCUMENTS

| | | | |
|---|---|---|---|
| CN | 201433629 | Y * | 3/2010 |
| CN | 202831962 | U * | 3/2013 |
| CN | 203081128 | U * | 7/2013 |
| CN | 203321154 | U * | 12/2013 |

* cited by examiner

BLIND HINGE USED FOR FURNITURE

FIELD OF THE INVENTION

The present utility model relates to a blind hinge for furniture.

BACKGROUND OF THE PRIOR ART

On May 17, 2006, Chinese patent (patent document number: CN2780937Y) disclosed a blind hinge for furniture door which can realize three-dimensional direction adjustment, comprising a movable base which can be fixed on the door body, an adjustable base which can be fixed on the door frame and a rotary arm connected between the movable base and the adjustable base, wherein the adjustable base comprises a base plate which can be fixed on the door frame, a middle plate which is designed to slide up/down on the base plate and an upper layer adjusting plate which is designed to slide forward/backward on the middle plate, namely the base plate on the door frame is designed as three-layer plate part structure, where the middle plate is formed through alloy casting and is riveted with the lower-layer adjusting plate after re-extrusion. Although the said invention has simple production process, this production process brings some hidden troubles for the quality of hinge. After re-extrusion of alloy casting, changes will take place in the internal structure of the material, such as looser structure and cracking. So, it is difficult for the production process to ensure the reliability of riveting between alloy casting and upper layer regulating plate, leading to unsatisfactory strength of hinge, easy drop of door plate, short service life, complicated structure, many assembly parts as well as high manufacturing and maintenance costs. Therefore, it is necessary to make further improvement.

DESCRIPTION OF UTILITY MODEL

It is the technical objective of the present utility model to provide a blind hinge for furniture, which is featured by simple and reasonable structure, reliable performance, simple assembly process, low production cost, high structural strength and good practicability, so as to overcome the deficiencies in the prior art.

A blind hinge used for furniture designed according to this objective, comprising a movable cup holder provided on the furniture door body, an adjusting base provided on the furniture body, a rotary arm connected between the movable cup holder and the adjusting base as well as an elastic element designed to generate opening/closing acting force on the movable cup holder; characterized in that, the adjusting base is designed as L-shape or bent shape and to realize three-dimensional or two-dimensional adjustment to the hinge; a convex step used to support the elastic member is integrally formed on the bottom base the movable cup holder; the elastic member is a torsion spring, with its section on at least one of its end parts being square or circular; the adjusting base comprises a connecting piece, and the connecting piece is provided with a boss and a convex part.

In the first embodiment, the adjusting base comprises a connecting piece, a movable plate and a base plate; the rotary arm is rotatablely assembled on the bent plane on one side of the connecting piece, and the adjustment to their relative positions is completed through a first eccentric adjustment rivet; the movable plate and the base plate are in turn assembled in the bent plane on the opposite side of the connecting piece, the adjustment to their relative positions is completed through a second eccentric adjustment rivet and a third eccentric adjustment rivet, so that the three-dimensional adjustment to the hinge is realized.

The first eccentric adjustment rivet, the second eccentric adjustment rivet and the third eccentric adjustment rivet are arranged in triangle form on the whole; the first eccentric adjustment rivet passes through a first adjusting hole on the rotary arm and is assembled on the connecting piece; the second eccentric adjustment rivet passes through the second adjusting hole on the connecting piece and is assembled on the movable plate; the third eccentric adjustment rivet passes through the third adjusting hole on the movable plate and is assembled on the base plate; a fixed plate is provided at the bottom of the movable plate and is positioned in coordination with the second eccentric adjustment rivet and/or the third eccentric adjustment rivet.

Both sides of the connecting piece are bent to form a groove; both sides of the movable plate are correspondingly bent to form a strip-type convex part, which is assembled in the groove; the movable plate has a certain working space in the groove; a guide slot used to limit the backward/forward movement of the movable plate is provided at the front end and/or rear end of the base plate, the front end and/or rear end of the movable plate is slideably placed in the guide slot; two corners at front end and/or rear end of the base plate are bent to form a claw, which is designed to be embedded into the main body frame of furniture and thus realize the positioning of base plate.

In the second embodiment, the adjusting base comprises a connecting piece and a movable plate; the rotary arm is rotatablely assembled on the bent plane on one side of the connecting piece, and the adjustment to their relative positions is completed through a first eccentric adjustment rivet; the movable plate is movably assembled in the bent plane on the opposite side of the connecting piece, the adjustment to their relative positions is completed through a second eccentric adjustment rivet, so that the two-dimensional adjustment to the hinge is realized.

The first eccentric adjustment rivet passes through the first adjusting hole on the rotary arm and is assembled on the connecting piece; the second eccentric adjustment rivet passes through the second adjusting hole on the connecting piece and is assembled on the movable plate; a fixed plate is provided at the bottom of the movable plate and is positioned in coordination with the second eccentric adjustment rivet.

Both sides of the connecting piece are bent to form a groove, both sides of the movable plate are correspondingly bent to form a strip-type convex part and assembled in the groove, and the movable plate has a certain working space in the groove; two corners at front end and/or rear end of the base plate are bent to form a claw, which is designed to be embedded into the main body frame of furniture and thus realize the positioning of movable plate.

In addition, all the said embodiments have the following structure: flanged edges formed through bending or extrusion are provided on both sides of the rotary arm and extend outwards to form a side wing, a groove and two internal side edges, which are slideably inserted into an open-type sliding chute provided corresponding to the connecting piece; at the same time, a limiting protrusion portion is provided on the sliding chute; a boss is integrally formed on the connecting piece through stamping, 2 side edges are formed in sliding fit with the internal side edge; the side wall of the connecting piece is bent and extruded inwards to form a convex part, an open slot is provided on the side wall where the movable plate is corresponding to the convex part, with both parts in sliding fit.

The movable cup holder and the step are integrally formed through stamping; the step is so designed that single side is torn or four sides are not torn, namely, the step and the movable cup holder are mutually connected through 3 or 4 sides; the elastic element is composed of two torsion springs in mirror symmetry, which are respectively mounted in the sags on both sides at the bottom of movable cup holder; a straight end and a bent end are provided on the torsion spring, wherein the straight end extends into the cup body of the movable cup holder and is elastically pressed on the rotary arm; the bent end is supported on the step; when the step is designed that single side is torn open, the bent end of the torsion spring is inserted into the hole formed through tearing; when the step is so designed that any of four sides is not torn open, the bent end of the torsion spring abuts on the sides of the step.

One end of the rotary arm extends into the cup body of the movable cup holder and is rotatablely connected with the movable cup holder through a pin shaft; arc-shaped surfaces are provided on both sides of the end where the rotary arm extends into the cup body of the movable cup holder, and the straight end of the torsion spring abuts on the arc-shaped surfaces. Both the rotary arm and the adjusting base are integrally molded through metal stamping and bending.

Through the improvement to said structure, namely the provision of L-shaped adjusting base, the present utility model can adapt to different furniture bodies and thus has wider scope of application. In addition, through the adjusting base, the user can perform three-dimensional or two-dimensional adjustment to hinge according to need, so this design is more humanized. In addition, through integrally molded and provided step, the torsion springs can be directly assembled on the movable cup holder without need for any auxiliary part. Therefore, this structure can further reduce the production cost while simplifying the assembly process and manufacturing process. The present utility model is featured by simple and reasonable structure, reliable performance, simplified assembly process, simple manufacturing process, low manufacturing cost, high structure strength and wide applicability.

DESCRIPTION OF ATTACHED DRAWINGS

DETAILED DESCRIPTION OF PREFERRED EMBODIMENTS

Figure 1:
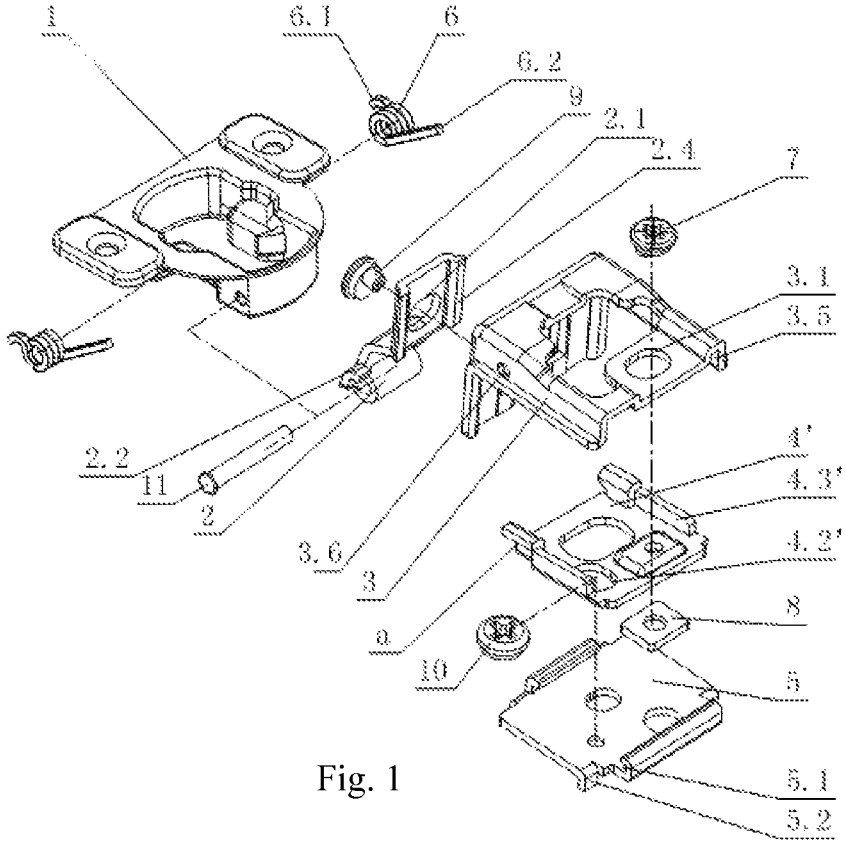
FIG. 1 is the breakdown structure diagram of the first embodiment of the present utility model.
Figure 2:
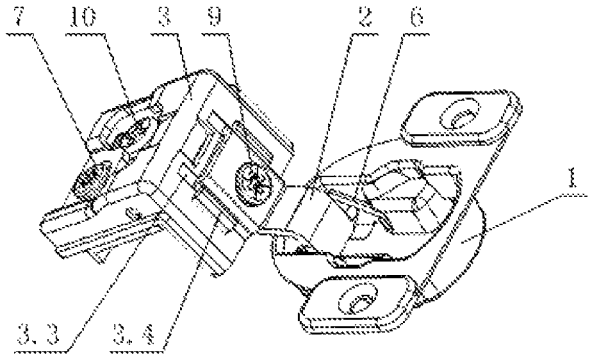
FIG. 2 is the assembly structure diagram of the first embodiment of the present utility model.

Further detailed description of the present utility model is provided with reference to specific embodiments in combination with attached drawings.

The First Embodiment

As shown in FIGS. 1-7, the blind hinge used for furniture comprises a movable cup holder 1 provided on the furniture door body, an adjusting base provided on the furniture body, a rotary arm 2 connected between the movable cup holder 1 and the adjusting base as well as an elastic element designed to generate opening/closing acting force on the movable cup holder 1. The adjusting base is designed as L-shape to adapt to different furniture bodies and realize three-dimensional adjustment to the hinge, thus being more humanized; the integrated molding of the bottom wall of the movable cup holder 1 is used to support the convex step 1.2 of the elastic part and contribute to even reliable assembly of elastic element; the elastic element is torsion spring 6 with the sections on both end parts being square. The square sections can effectively prevent the torsion spring from derivation under stress, which may otherwise affect effect.

As shown in FIGS. 1-2 and FIGS. 6-7, the adjusting base comprises a connecting piece 3, a movable plate 4' and a base plate 5; the rotary arm 2 is movably assembled on the bent plane on one side of the connecting piece 3, and the adjustment to their relative positions is completed through a first eccentric adjustment rivet 9; the movable plate 4' and the base plate 2 are in turn assembled in the bent plane on the opposite side of the connecting piece 3, the movable plate 4' is movably placed between the connecting piece 3 and the base plate 5, the adjustment to their relative positions is completed through a second eccentric adjustment rivet 7 and a third eccentric adjustment rivet 10, so that the three-dimensional adjustment to hinge is realized.

Specifically, the first eccentric adjustment rivet 9, the second eccentric adjustment rivet 7 and the third eccentric adjustment rivet 10 are arranged in triangle form on the whole; the first eccentric adjustment rivet 9 passes through a capsule-shaped first adjusting hole 2.1 on the rotary arm 2 and is assembled on the connecting piece 3; the relative up/down adjustment is realized by rotating the first eccentric adjustment rivet 9; the second eccentric adjustment rivet 7 passes through a capsule-shaped second adjusting hole 3.1 on the connecting piece 3 and is then assembled on the movable plate 4', and is positioned in coordination with the fixed plate 8 at the bottom of the movable plate 4'; the relative forward/backward adjustment is realized by rotating the second eccentric adjustment rivet 7; the third eccentric adjustment rivet 10 passes through a capsule-shaped third adjusting hole 4.2' on the movable plate 4' and is assembled on the base plate 5; the relative left/right adjustment is realized by rotating the third eccentric adjustment rivet 10.

For the purpose of completing assembly and adjustment with better effect, both sides of the connecting piece 3 are bent to form a groove 3.5; both sides of the movable plate 4' are correspondingly bent to form a strip-type convex part 4.3', which is assembled in the groove 3.5; the movable plate 4' has a certain working space in the groove 3.5 to facilitate forward/backward positioning and adjustment; a guide slot 5.1 used to limit the backward/forward movement of the movable plate 4' is provided at the front and/or rear end of the base plate 5, the front and/or rear end of the movable plate 4' is slideably placed in the guide slot 5.1 to facilitate left/right positioning and adjustment; two corners at the front end of the base plate 5 are bent to form a claw 5.2, which is designed to be embedded into the main body frame of furniture and thus realize the positioning of the base plate 5.

Flanged edges formed through bending or extrusion are provided on both sides of the rotary arm 2 and extend outwards to form a side wing 2.4, a groove 2.3 and two internal side edges 2.5, which are slideably inserted into an open-type sliding chute 3.3 provided corresponding to the connecting piece 3; at the same time, a limiting protrusion portion 3.4 is provided on the sliding chute 3.3 to generate positioning action; a boss 3.2 is integrally formed on the connecting piece 3 through stamping; on both sides, 2 side edges 3.7 are formed in sliding fit with the internal side edge 2.5; the side wall of the connecting piece 3 is bent and extruded inwards to form a convex part 3.6, an open slot a is provided on the side wall where the movable plate is corresponding to the convex part 3.6, with both parts in sliding fit.

Figure 3:
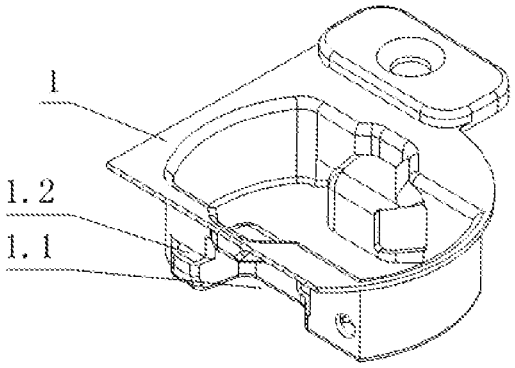
FIG. 3 is the structure diagram of the movable cup holder in the first embodiment of the present utility model.
Figure 4:
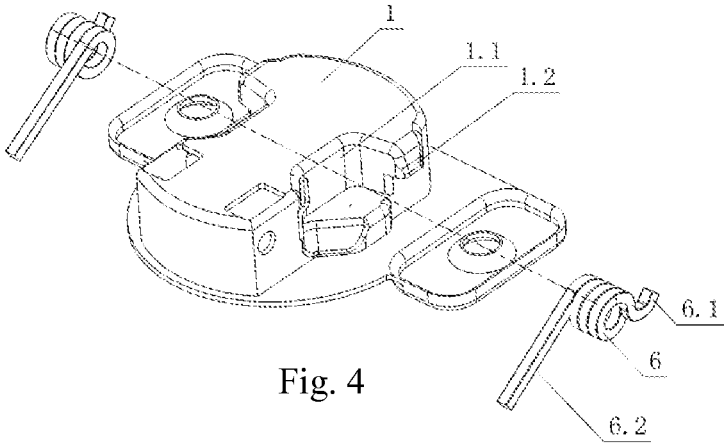
FIG. 4 is the breakdown structure diagram of the movable cup holder and the torsion spring in the first embodiment of the present utility model.
Figure 5:
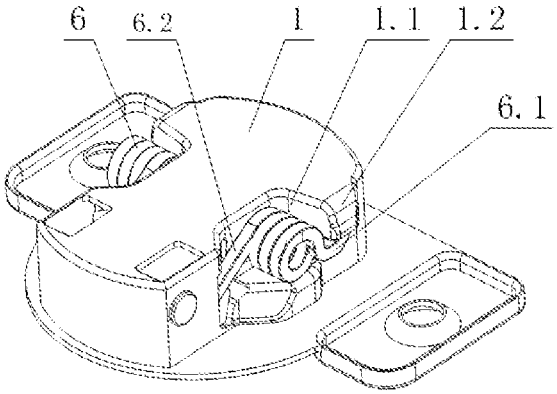
FIG. 5 is the assembly structure diagram of the movable cup holder and the torsion spring in the first embodiment of the present utility model.
Figure 6:
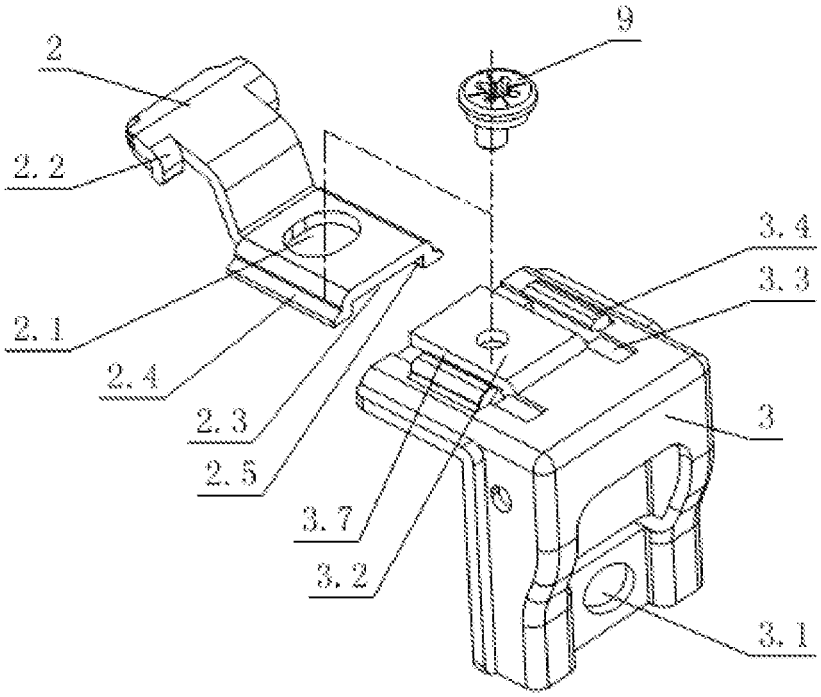
FIG. 6 is the breakdown structure diagram of the rotary arm and the connecting piece in the first embodiment of the present utility model.
Figure 7:
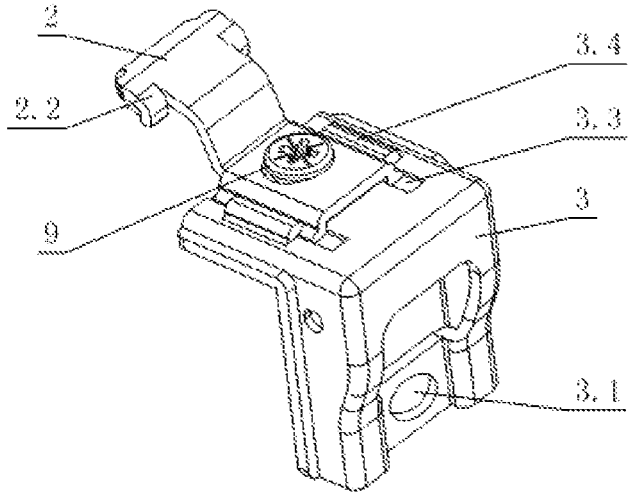
FIG. 7 is the assembly structure diagram of the rotary arm and the connecting piece in the first embodiment of the present utility model.

As shown in FIGS. 3-5, the movable cup holder 1 and the step 1.2 are integrally formed through stamping; the step 1.2 is so designed that single side is torn. Therefore, through hole is formed on the torn side, namely, the step 1.2 and the movable cup holder 1 are mutually connected through 3 sides; the elastic element is composed of two torsion springs in mirror symmetry 6, which are respectively mounted in the sags 1.1 on both sides at the bottom of movable cup holder 1; a straight end 6.2 and a bent end 6.1 are provided on the torsion spring 6, wherein the straight end 6.2 extends into the cup body of the movable cup holder 1 and is elastically pressed on the rotary arm 2; the bent end 6.1 is supported on the step 1.2, namely the bent end 6.1 is inserted into the hole formed through tearing.

One end of the rotary arm extends into the cup body of the movable cup holder 1 and is rotatablely connected with the movable cup holder 1 through a pin shaft 11; arc-shaped surfaces 2.2 are provided on both sides of the end where the rotary arm 2 extends into the cup body of the movable cup holder 1, and the straight end 6.2 of the torsion spring 6 abuts on the arc-shaped surfaces 2.2. Since the section at end part is square, as compared with the traditional torsion spring, this torsion spring 6 will unlikely generate derivation under stress; the direction under stress is accurate, so that the reliability of hinge is ensured. Both the rotary arm 2 and the adjusting base are integrally molded through metal stamping and bending, thus facilitating generation and installation.

The Second Embodiment

Figure 8:
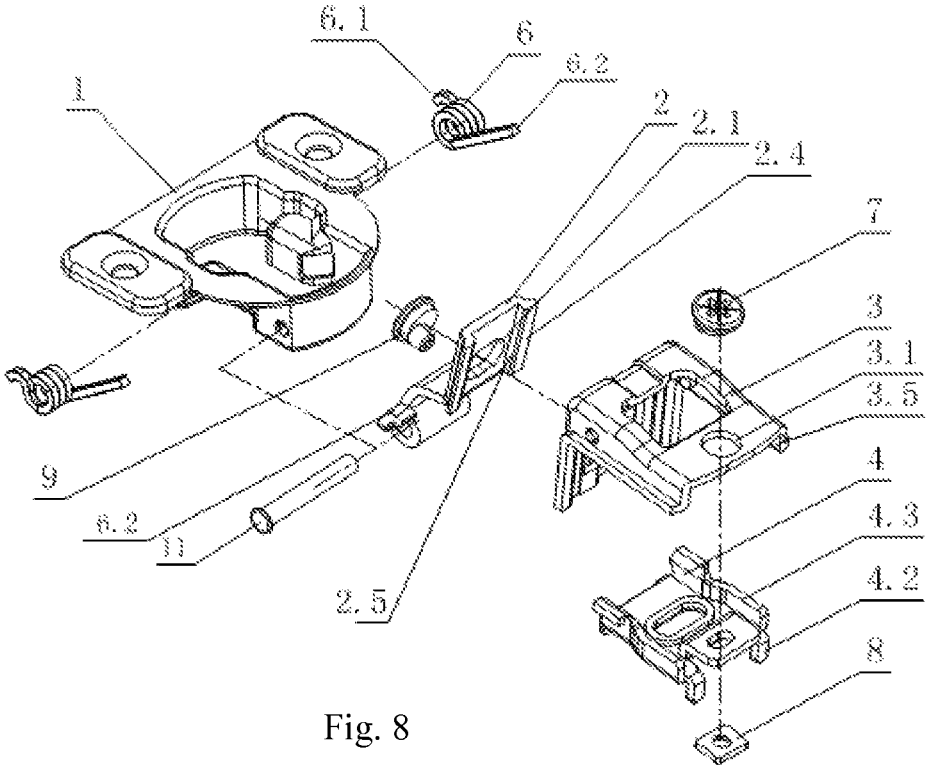
FIG. 8 is the breakdown structure diagram of the second embodiment of the present utility model.
Figure 9:
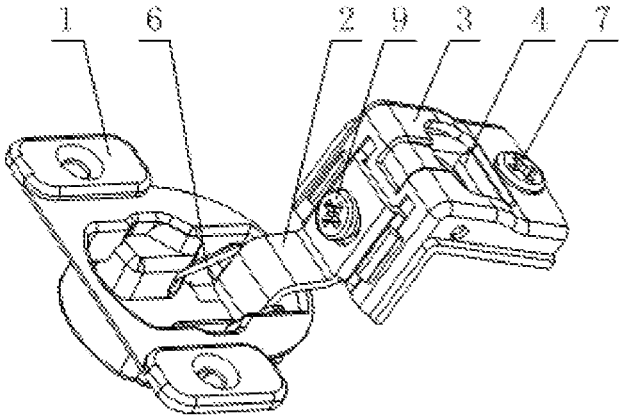
FIG. 9 is the assembly structure diagram of the second embodiment of the present utility model.
Figure 10:
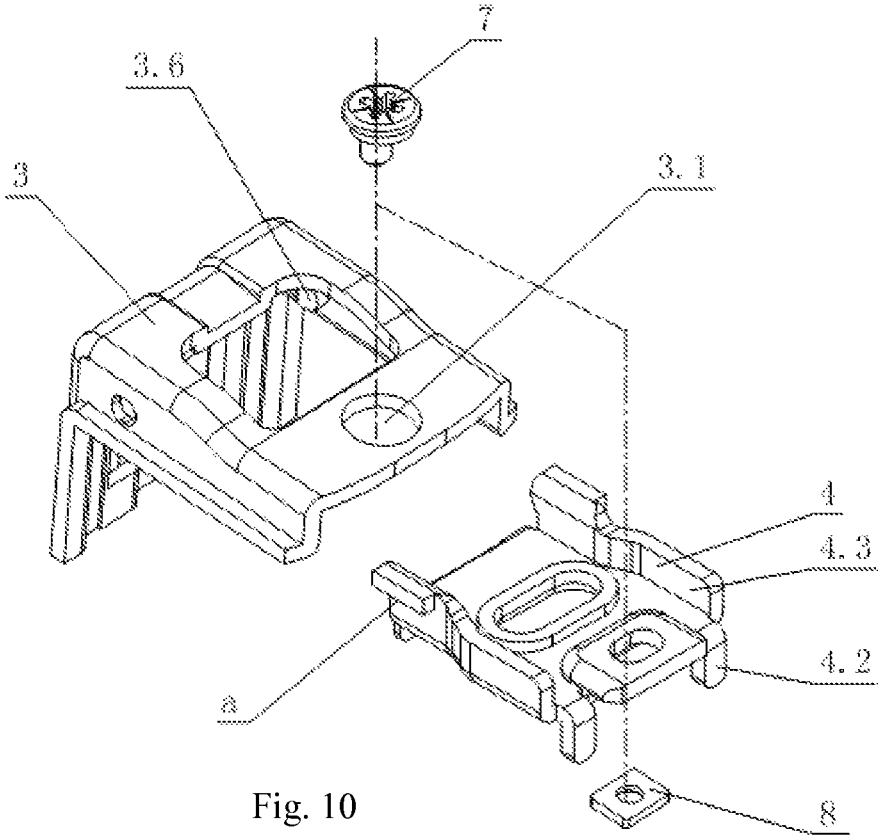
FIG. 10 is the breakdown structure diagram of the connecting piece and the movable plate in the second embodiment of the present utility model.

As shown in FIGS. 8-10, the hinge used for furniture differs from the first embodiment in the following aspects: the adjusting base comprises a connecting piece 3 and a movable plate 4; the rotary arm 2 is rotatablely assembled on the bent plane on one side of the connecting piece 3, and the adjustment to their relative positions is completed through a first eccentric adjustment rivet 7; the movable plate 4 is movably assembled in the bent plane on the opposite side of the connecting piece 3, the adjustment to their relative positions is completed through a second eccentric adjustment rivet 7, so that the two-dimensional adjustment to the hinge is realized.

Specifically, the first eccentric adjustment rivet 9 passes through a capsule-shaped first adjusting hole 2.1 on the rotary arm 2 and is assembled on the connecting piece 3; the relative up/down adjustment can be realized by rotating the first eccentric adjustment rivet 9; the second eccentric adjustment rivet 7 passes through the second adjusting hole 3.1 on the connecting piece 3 and is assembled on the movable plate 4; the relative forward/backward adjustment can be realized by rotating the second eccentric adjustment rivet 7; a fixed plate 8 is provided at the bottom of the movable plate 4 and is positioned in coordination with the second eccentric adjustment rivet 7.

Both sides of the connecting piece 3 are bent to form a groove 3.5, both sides of the movable plate 4 are correspondingly bent to form a strip-type convex part 4.3 and assembled in the groove 3.5, and the movable plate 4 has a certain working space in the groove 3.5; two corners at front and/or rear end of the base plate are bent to form a claw 4.2, which is designed to be embedded into the main body frame of furniture and thus realize the positioning of movable plate 4.

The other unmentioned parts are same as those in the first embodiment, so it is no longer necessary to make analysis and description on these parts.

The preferred embodiments of the present utility model are described above. All the simple modifications or transformations made by those skilled in the art to these embodiments fall within the claims of the present utility model.

The invention claimed is:

1. A blind hinge used for furniture, comprising a movable cup holder provided on a furniture door body, an adjusting base provided on a furniture body, a rotary arm connected between the movable cup holder and the adjusting base as well as an elastic element designed to generate opening/closing acting force on the movable cup holder; wherein the adjusting base is designed as one of an L-shape or bent shape and to realize three-dimensional or two-dimensional adjustment to the hinge; a convex step used to support the elastic element is integrally formed on a bottom base of the movable cup holder; the elastic element is a torsion spring, with a section on at least one of the torsion spring end parts being square or circular; the adjusting base comprises a movable plate, a base plate and a connecting piece and the connecting piece is provided with a boss and a convex part; the rotary arm is movably assembled on a bent plane on one side of the connecting piece, and the adjustment to the relative positions of the rotary arm and connecting piece is completed through a first eccentric adjustment rivet; wherein the movable plate and the base plate are in turn assembled in the bent plane on the opposite side of the connecting piece, the adjustment to the relative positions of the movable plate and the connecting piece is completed through a second eccentric adjustment rivet, and the adjustment to the relative positions of the base plate and the connecting piece is completed through a third eccentric adjustment rivet, so that the three-dimensional adjustment to the hinge is realized; wherein the first eccentric adjustment rivet, the second eccentric adjustment rivet and the third eccentric adjustment rivet are arranged in triangle form; wherein the first eccentric adjustment rivet passes through a first adjusting hole on the rotary arm and is assembled on the connecting piece; wherein the second eccentric adjustment rivet passes through a second adjusting hole on the connecting piece and is assembled on the movable plate; wherein the third eccentric adjustment rivet passes through a third adjusting hole on the movable plate and is assembled on the base plate; and wherein a fixed plate is provided at the bottom of the movable plate and is positioned in coordination with the second eccentric adjustment rivet and/or the third eccentric adjustment rivet.

2. The blind hinge used for furniture of claim 1, wherein both sides of the connecting piece are bent to form a groove, both sides of the movable plate are correspondingly bent to form the convex part which is strip-shaped and assembled in the groove, and the movable plate has a certain working space in the groove; wherein a guide slot used to limit the backward/forward movement of the movable plate is provided at the front end and rear end of the base plate, such that at least one of the front end and rear end of the movable plate is slideably placed in the guide slot; and wherein two corners at the front end and/or rear end of the base plate are bent to form a claw.

3. A blind hinge used for furniture, comprising a movable cup holder provided on a furniture door body, an adjusting base provided on a furniture body, a rotary arm connected between the movable cup holder and the adjusting base as well as an elastic element designed to generate opening/closing acting force on the movable cup holder; wherein the adjusting base is designed as one of an L-shape or bent shape and to realize three-dimensional or two-dimensional adjustment to the hinge; a convex step used to support the elastic element is integrally formed on a bottom base of the movable cup holder; the elastic element is a torsion spring, with a section on at least one of the torsion spring end parts being square or circular; the adjusting base comprises a movable plate, a base plate and a connecting piece and the connecting piece is provided with a boss and a convex part; the rotary arm is movably assembled on a bent plane on one side of the connecting piece, and the adjustment to relative positions of the rotary arm and connecting piece is completed through a first eccentric adjustment rivet; and wherein the movable plate is movably assembled in the bent plane on the opposite side of the connecting piece, and adjustment to the relative positions of the movable plate and connecting piece is completed through a second eccentric adjustment rivet, so that the two-dimensional adjustment to the hinge is realized; wherein the first eccentric adjustment rivet passes through a first adjusting hole on the rotary arm and is assembled on the connecting piece; wherein the second eccentric adjustment rivet passes through a second adjusting hole on the connecting piece and is assembled on the movable plate; wherein a fixed plate is provided at the bottom of the movable plate and is positioned in coordination with the second eccentric adjustment rivet; wherein both sides of the connecting piece are bent to form a groove; wherein both sides of the movable plate are correspondingly bent to form the convex part which is strip-shaped and assembled in the groove; wherein the movable plate has a certain working space in the groove; and wherein two corners at the front end and/or rear end of the movable plate are bent to form a claw.

4. A blind hinge used for furniture, comprising a movable cup holder provided on a furniture door body, an adjusting base provided on a furniture body, a rotary arm connected between the movable cup holder and the adjusting base as well as an elastic element designed to generate opening/closing acting force on the movable cup holder; wherein the adjusting base is designed as one of an L-shape or bent shape and to realize three-dimensional or two-dimensional adjustment to the hinge; a convex step used to support the elastic element is integrally formed on a bottom base of the movable cup holder; the elastic element is a torsion spring, with a section on at least one of the torsion spring end parts being square or circular; the adjusting base comprises a movable plate, a base plate and a connecting piece and the connecting piece is provided with a boss and a convex part; the rotary arm is movably assembled on a bent plane on one side of the connecting piece, and the adjustment to the relative positions of the rotary arm and connecting piece is completed through a first eccentric adjustment rivet; wherein the movable plate and the base plate are in turn assembled in the bent plane on the opposite side of the connecting piece, the adjustment to the relative positions of the movable plate and the connecting piece is completed through a second eccentric adjustment rivet, and optionally adjustment to the relative positions of the base plate and the connecting piece is completed through a third eccentric adjustment rivet, so that the three-dimensional or two-dimensional adjustment to the hinge is realized;

wherein flanged edges formed through bending or extrusion are provided on both sides of the rotary arm and extend outwards to form a side wing, a groove and two internal side edges, which are slideably inserted into an open sliding chute provided corresponding to the connecting piece; wherein, at the same time, a limiting protrusion portion is provided on the sliding chute; wherein the boss is integrally formed on the connecting piece through stamping, two side edges are formed in sliding fit with the internal side edge; and wherein a side wall of the connecting piece is bent and extruded inwards to form the convex part, an open slot is provided on the side wall where the movable plate is corresponding to the convex part, with the movable plate and the convex part in sliding fit.

5. The blind hinge used for furniture of claim 4, wherein the movable cup holder and the step are integrally formed through stamping; wherein the step has four sides and at least three sides of the step are connected to the movable cup holder;

wherein the elastic element is comprised of two torsion springs in mirror symmetry, which are respectively mounted in sags on both sides at the bottom base of the movable cup holder; wherein the torsion spring end parts comprise a straight end and a bent end, wherein the straight end extends into a cup body of the movable cup holder and is elastically pressed on the rotary arm; and wherein the bent end is supported on the step; wherein when three sides of the step are connected to the movable cup holder, the bent end of the torsion spring is inserted into an opening formed between the step and the movable cup at an unconnected side of the step and when all four sides of the step are connected, the bent end of the torsion spring abuts the sides of the step.

6. The blind hinge used for furniture of claim 5, wherein one end of the rotary arm extends into the cup body of the movable cup holder and is rotatably connected with the movable cup holder through a pin shaft; and wherein arc-shaped surfaces are provided on both sides of the one end of the rotary arm at the location where the rotary arm extends into the cup body of the movable cup holder, and the straight end of the torsion spring abuts on the arc-shaped surfaces.

* * * * *